US005413400A

United States Patent [19]

Llanes

[11] Patent Number: 5,413,400

[45] Date of Patent: May 9, 1995

[54] PORTABLE DESK ASSEMBLY

[76] Inventor: Carlos Llanes, 3440 E. 9th Ct., Hialeah, Fla. 33013

[21] Appl. No.: 183,314

[22] Filed: Jan. 19; 1994

Related U.S. Application Data

[63] Continuation-in-part of Ser. No. 904,034, Jun. 25, 1992, abandoned.

[51] Int. Cl.[6] ..... A47C 4/00

[52] U.S. Cl. ..... 297/154; 297/188.04; 297/217.1; 297/16.1; 297/423.27; 297/188.02

[58] Field of Search ..... 297/154, 155, 217, 135, 297/148, 180.1, 194, 188, 423.1, 423.19, 423.21, 423.26, 423.27, 16.1, 30, 35, 46

[56] References Cited

U.S. PATENT DOCUMENTS

| | | | |
|---|---|---|---|
| 325,178 | 8/1885 | Knowlton | 297/155 |
| 529,380 | 11/1894 | Halliburton | 297/154 |
| 568,134 | 9/1896 | Gable | 297/194 X |
| 597,598 | 1/1898 | Yznaga | 297/155 |
| 1,136,300 | 4/1915 | Vaughn | 297/155 X |
| 2,587,731 | 3/1952 | Irving | 297/180.1 |
| 4,288,123 | 9/1981 | Cone | 297/154 |

FOREIGN PATENT DOCUMENTS

| | | | |
|---|---|---|---|
| 0126098 | 8/1931 | Austria | 297/217 |
| 0947210 | 6/1949 | France | 297/154 |

*Primary Examiner*—Kenneth J. Dorner
*Assistant Examiner*—Milton Nelson, Jr.
*Attorney, Agent, or Firm*—Malloy & Malloy

[57] ABSTRACT

A folding chair and desk combination wherein the chair includes a seat, a back, support legs, and two arms, the arms are spaced generally parallel from one another and extend outwardly providing support for a desk which is adjustably and hingedly connected to one of the arms. The desk, when in use, spans the extending armportions and is swingable to a generally vertical attitude for access by a user to the seat. Further, an enlarged support base structure is provided for stability, the support base structure extending beneath the desk so as to enlarge the zone of support beneath the desk.

12 Claims, 2 Drawing Sheets

PORTABLE DESK ASSEMBLY

BACKGROUND OF THE INVENTION

The present is a continuation-in-part application to the previously filed, now abandoned as of May 12, 1994, application filed on Jun. 25, 1992 and assigned Ser. No. 07/904,034.

1. Field of the Invention

The present invention relates to a collapsible, foldable desk and chair assembly.

2. Background of the Invention

In the past, there have been numerous types of folding collapsible chairs and this art is well known. This invention provides a folding chair which, in addition, includes a desk, so that the assembly can be used to provide a comfortable place to study as well as sit. Since it is portable, it can be easily carried to a convenient place. The folding device is ideal as it fits in the trunk of an automobile allowing one to take it along to a park, a seashore, a lakefront, or simply to place it in a desired location in one's own backyard. Thus, a user is able to select a place where he prefers to study. Optionally, the device may include an electrical system so as to assure that appropriate lighting is available in the study environment.

The device of the present invention is ideal for use in hotels, churches, or any other institution where conferences, seminars, or group studies are held. These places generally provide sitting facilities, but do not offer a convenient place for writing or signing papers. Even though such places do provide desks, but without individual electrical lamps because the rooms have their own lighting, a portable desk such as that of the present invention would nevertheless save a lot of space as it can be folded once the meeting is over and the site is promptly restored to its regular function. Further, lighting in large rooms is not always sufficient for extended amounts of reading, thereby necessitating that individual lighting sources be provided at a particular desk.

There are numerous patents directed to high chairs which contain some sort of a tray assembly thereon. Such patents include French Patent No. 947210, and the U.S. patent to Danielson, U.S. Pat. No. 2,762,161, Gable, U.S. Pat. No. 568,134, Vaughn, U.S. Pat. No. 1,136,300, and Quinlan, Jr., U.S. Pat. No. 4,795,209. Similarly, there are numerous desk and chair combinations such as those recited in the patents to Yznagau, U.S. Pat. No. 597,598, and Halliburton, U.S. Pat. No. 529,380. None of these patents, however, teach or provide an assembly which is completely foldable and collapsible so as to make the assembly completely portable. Further, none of the devices of the prior art teach an adult size desk with a comfortable work space, the desk being specifically adapted with added support such that if books or heavy objects are positioned on the desk, which naturally must be spaced a slight distance from a user in order to allow the user to sit in the chair and still conveniently use the desk, the assembly will not tip forward towards the desk, but rather will remain properly supported and oriented even when a user is not actually sitting in the chair.

SUMMARY OF THE INVENTION

The present invention is directed towards a folding chair assembly adapted to be completely portable and provide a comfortable and useful work area at any desired location. Specifically, the chair assembly includes a seat with a back pivotally connected to the seat. Extending above the seat and away from the back are two arms. These two arms are disposed in spaced, substantially parallel relation to one another, thereby providing arm support to an individual seated on the seat. Pivotably and adjustably attached to one of the arms is a desk. This desk may be selectively positioned between an operative position and an open position. Particularly, the operative position is defined by the desk spanning the arms, and the open position includes the desk in a hingedly raised position enabling a user to be seated or get up from the chair. Supporting the seat and the back on a supporting surface are support means. The support means include a front leg assembly, which is mounted adjacent to a front portion of the seat, and a rear leg assembly, which is mounted adjacent a rear portion of the seat. The front leg assembly and rear leg assembly extend downwardly from the seat into engagement with a supporting surface, thereby importing the seat and the back thereon. In addition to the front and rear leg assemblies, the support means also include a retractable support base structure. This retractable support base structure provides supplemental support to the seat, the back, and the desk such that a weight of the desk or objects thereon will not result in tipping of the chair assembly. The support base structure is pivotally connected to the front leg assembly in such a manner that it is positionable between a stored position and a supporting position. In the supporting position, the support base structure extends outwardly from the front leg assembly into engaging relation along the supporting surface so as to be substantially beneath the desk when the desk is in its operative position. In order to provide easy portability, the seat, the back, the arms, the support means, and the desk are all pivotally interconnected with one another so as to be collectively disposable between an open position and a fully collapsible position whereby the chair assembly is substantially portable.

It is an object of the present invention to provide a folding chair and desk combination which is portable, easily stored, and is highly useful for study.

Still another object of the present invention is to provide a chair assembly including a seating area and a desk which is portable and which is able to stand alone without tipping despite a weight of the desk and study articles thereon.

BRIEF DESCRIPTION OF THE DRAWINGS

For a fuller understanding of the nature of the present invention, reference should be had to the following detailed description taken in connection with the accompanying drawings in which.

FIG. *7a* is a side view of the chair assembly of the present invention.

Figure 7A:
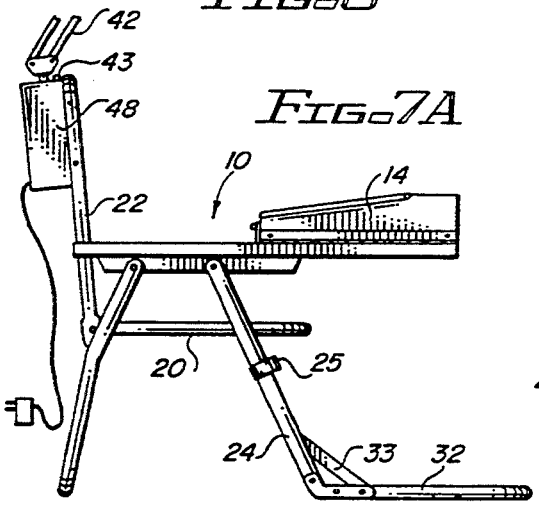
Figure 7B:
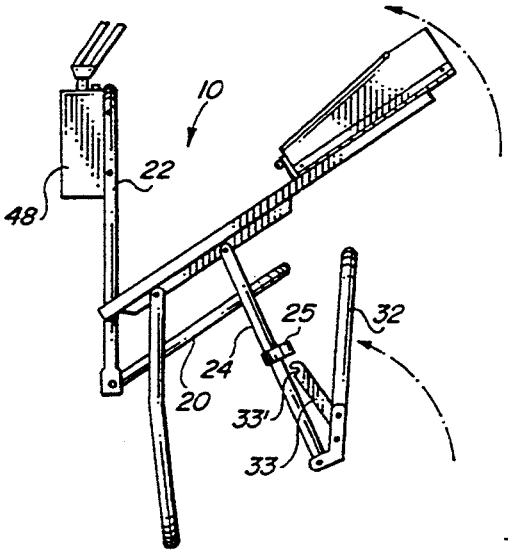
Figure 7C:
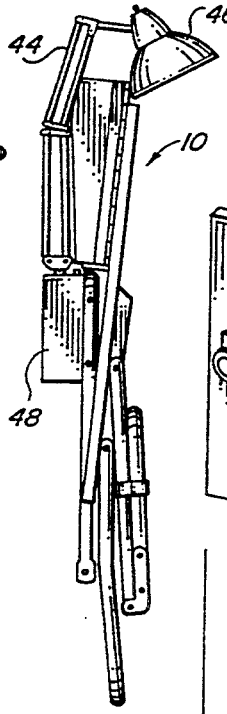

FIG. *7b* is a partially collapsed view of the chair assembly of the present invention FIG. 7c is a totally collapsed view of the assembly of the present invention.

Figure 8:
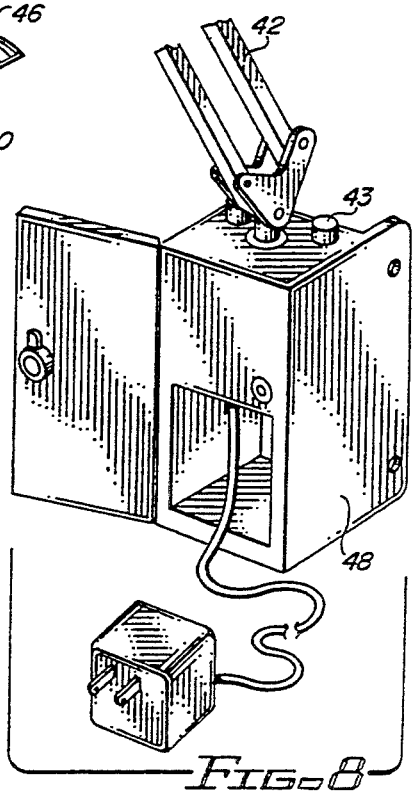

FIG. 8 is an isolated view of the power box of the present invention.

Figure 9:
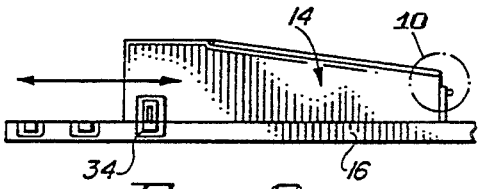

FIG. 9 is an isolated left side view of the desk of the present invention.

Figure 10:
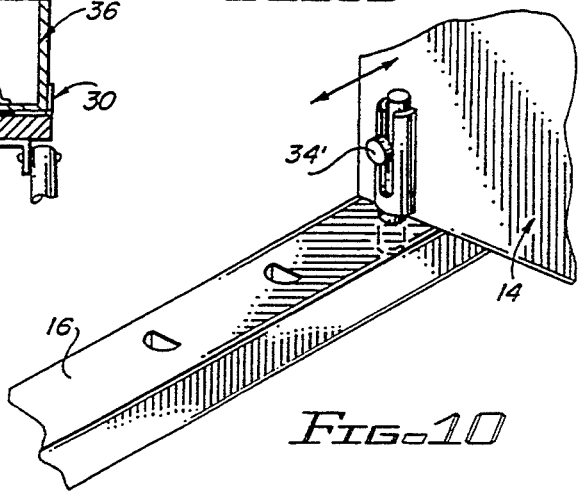

FIG. 10 is an isolated view of portion 10 of FIG. 9.

Like reference numerals refer to like parts throughout the several views of the drawings.

DETAILED DESCRIPTION OF THE PREFERRED EMBODIMENT

Figures 1, 2, 3, 4, 5:
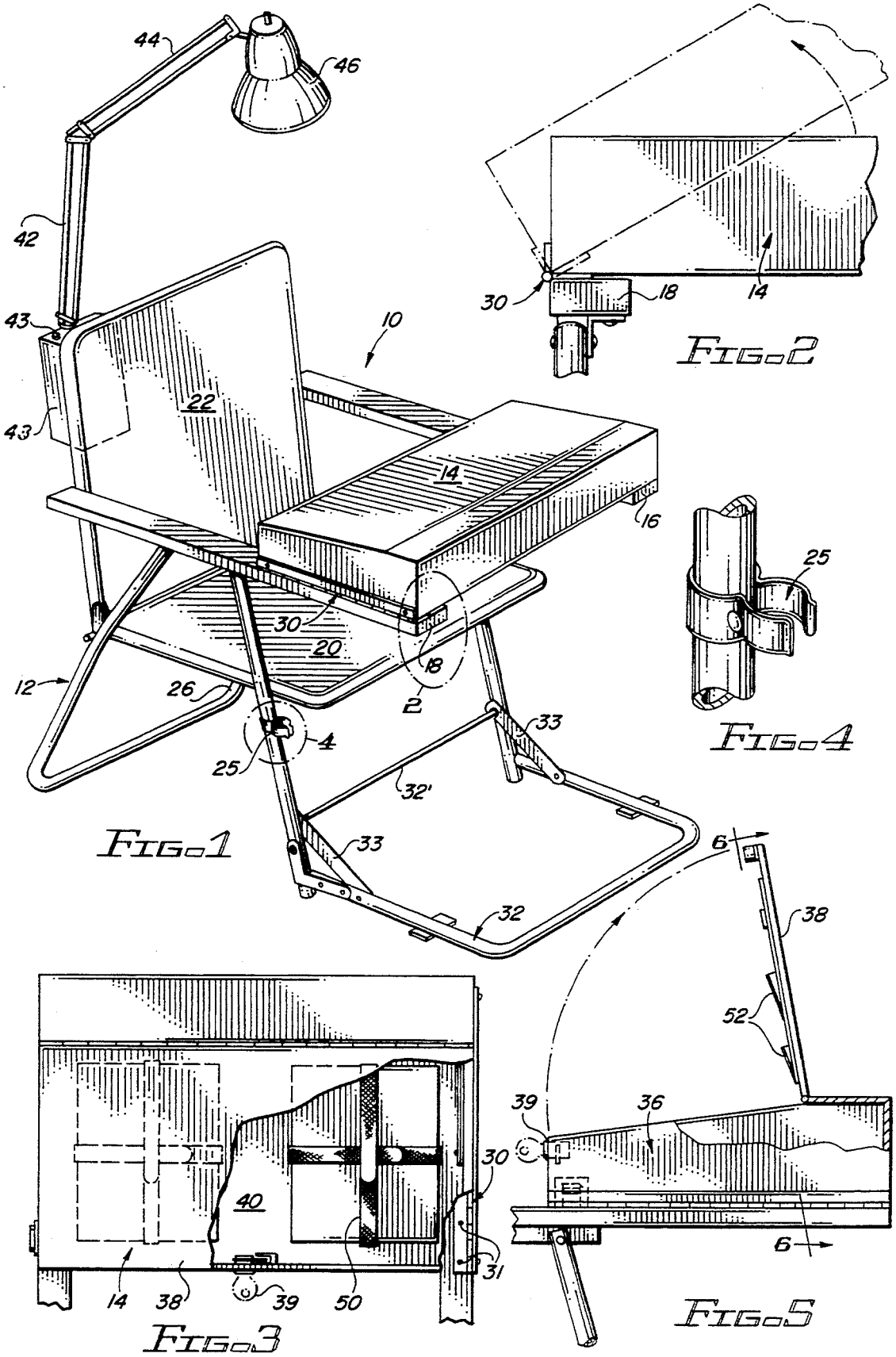
FIG. 1 is a perspective view of the chair assembly of the present invention.
FIG. 2 is an isolated view of portion 2 of FIG. 1.
FIG. 3 is an isolated, partial cutaway, top view of the desk of the present invention.
FIG. 4 is an isolated view of portion 4 of FIG. 1.
FIG. 5 is an isolated right side view of the desk of the present invention.
Figure 6:
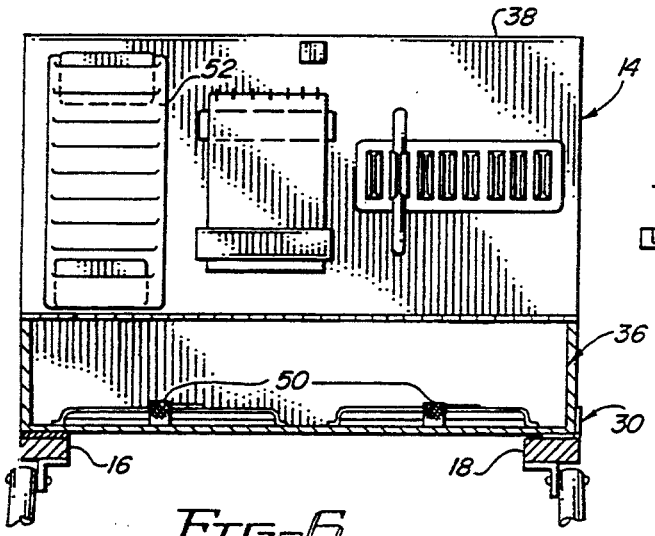
FIG. 6 is a cross-sectional view along line 6 of FIG. 5.

The present invention is directed towards a portable and collapsible chair assembly, generally indicated as 10. The assembly 10 is composed primarily of a foldable chair 12 and a desk 14 disposed thereon. Specifically, the chair 12 includes a seat 20 and a back 22 pivotally connected thereto. Extending away from the back 22 and hingedly secured thereto are a pair of arms 16 and 18 to be described in further detail hereafter. These arms 16 and 18 are disposed in spaced, substantially parallel relation to one another and extend over the seat 20 so as to provide suitable arm support for an individual seated within the chair. Spanning the two arms 16 and 18 is the desk 14. The desk 14 is pivotally and adjustably attached to one of the arms 18 so as to be movable between an operative position, as illustrated in FIG. 2, and an open position. The desk 14 is secured to the one arm 18 by an elongate hinge 30 secured to a side of the desk 14. The elongate hinge 30 includes therein a plurality of adjustment openings 31 where through a screw or like fastener may pass such that the desk 14 can be adjustably positioned along a length of the arms 16 and 18. This adjustable positioning facilitates comfortable use of the desk 14 by individuals of varying sizes and different desires as to the positioning of the desk 14 relative to their body. When in the operative position, the desk 14 supportably rests upon both arms 16 and 18 thereby providing a sturdy working surface upon which an individual can write, read or rest books or other various objects. When an individual wishes to be seated within the chair 12 or exit the chair 12, the desk 14 is pivoted upward so as to rest vertically on only one of the arms 18 thereby providing facilitated access to the seat 20 and back 22. Also, in order to ensure that the desk 14 is maintained in the operative position either during use or when the assembly is collapsed and because it is desirous to ensure that the desk 14 remains properly positioned, a pair of latch means 34 and 34' are included. Specifically, latch means 34 include a hingedly secured latch which is attached to the desk 14 and passes over a corresponding protrusion on the arm 16 thereby locking the desk 14 in place. As a further securing, latch means 34' are included to further secure the desk 14 in non-sliding movement within the operative position.

The desk 14 includes specifically a receptacle structure 36 and a swingable lid 38. The lid 38 when closed provides the work area to be used, and is preferably downwardly sloped towards a user seated in the chair 12 to further facilitate use of the work area. The receptacle structure 36 defines an interior compartment 40 within the desk 14. The interior compartment 40 is adapted to enable a variety of objects such as papers and books to be conveniently stored during portability of the assembly 10, thereby making them readily available for use with the assembly 10. In order to ensure that objects contained within the interior compartment 40 do not unnecessarily slide around therein, a plurality of tether means 50, preferably in the form of straps which can be either elastic or utilize hook and loop fastener pads for adjustability, are included. Further, a number of pockets 52 may be disposed within the interior compartment 40 or on an interior of the lid portion 30 to provide further convenient storage areas. Additionally, the desk 14 may include a lock 39 which provides added security to store items within the desk 14.

In order to support the seat 20, back 22, and desk 14, on a supporting surface such as a floor, support means are included. The support means include primarily a front leg assembly 24 and a rear leg assembly 26. The front leg assembly 24 is hingedly secured at a front end of the seat 20 and is further secured to the arms 16 and 18. The rear leg assembly 26 is pivotally connected at a rear of the seat 20 as well as with the arms 16 and 18. These leg assemblies 24 and 26 extend downwardly from the seat so as to engage the supporting surface and thereby support the entire assembly 10 thereon including the weight of a user seated within the chair 12. In order to ensure that a sufficiently large work area is provided on the desk 14, the arms 16 and 18 are substantially elongate as compared with standard collapsible chair arms. As a result of this length of the arms 16 and 18, if large quantities of items and accordingly substantial weight is positioned in or on the desk 14, the assembly 10 will tend to tip forward when a user is not seated within the chair 12. Accordingly, the assembly 10 includes a retractable support base structure 30 which provides supplemental support to the seat 20, back 22, and desk 14, preventing forward tipping of the assembly 10. Specifically, the retractable support base structure 32 is a generally U-shaped member which is pivotally connected to the front leg assembly 24 in such a manner that it is positionable between a stored position and a supporting position. When in the supporting position, the support base structure 32 extends outwardly from the front leg assembly 24 into an engaging relation with the supporting surface, thereby being positioned substantially beneath the desk 14 when the desk is in the operative position. In order to ensure that the support base structure 32 does not move to its stored position under a weight of objects on the desk 14, a pair of support rods 33 are hingedly secured to the support base structure 32. The support rods 33 are hingedly secured to the support base structure 32 at a proximal end thereof so as to be pivotally movable between a retracted position and a supporting position. When in the retracted position, a free distal end of the support rods 33 are adjacent the support base structure 32, and when in the supporting position, the free distal end of the support rods 33 engage the front leg assembly 24 in such a manner that the support base structure 32 cannot be pivotally moved to its stored position.

In the preferred embodiment, each of the support rods 33 include a slot 33' formed in its free distal end. The slot 33' is adapted preferably to engage a rod 32' which extends between each of the front legs of the front leg assembly 24. When, however, it is desirous to move the support base structure 32 to its stored position, the support rods 33 are disengaged from the front leg assembly 24 and the support base structure 32 is pivoted upwardly towards the front leg assembly 24. Further, in the preferred embodiment, a pair of clamp members 25 are disposed on the front leg assembly 24 so as to clampingly receive and hold the support base structure 32 therein.

Turning to FIG. 5, the seat 20, the back 22, the arms 16 and 18, the front leg assembly 24, the rear leg assembly 26, and the support base structure 32, are all hingedly and pivotally interconnected with one another such that the entire assembly 10 can be completely retracted. Particularly, with regard to the seat 20, back 22, arms 16 and 18, and front and rear leg assemblies 24 and 26, they retract in the conventional manner known to folding chairs wherein the arms 16 and 18 and seat 20 hingedly fold towards the back 22 while the leg assemblies fold towards one another so as to form essentially one elongate unit.

Further, the assembly 10 may include a light 46 so as to provide improved illumination on the work area of the desk 14. In order to provide the light 46, a power box 48 is mounted to the back 22 of the chair 12. The power box contains therein a battery, which can be disposable or rechargeable, as well as an adaptor to enable power to be drawn directly from an electrical outlet. Extending from a top of the power box 48 is a lamp support 42. The lamp support 42 preferably includes hinged sections to facilitate positioning of the lamp 46 over the work area of the desk 14, and includes a distal end zone 44 where the lamp 46 is positioned. Also disposed on top of the power box 48 are a pair of rotation stoppers 43 which are disposed so as to prevent excessive rotation of the lamp support 42, thereby preventing entanglement of a cord or unnecessary movement of the lamp 46.

Now that the invention has been described,

What is claimed is:

1. A folding chair assembly comprising:

a seat, a back pivotally connected to said seat, and two arms disposed in spaced, substantially parallel relation to one another and extending forwardly above and away from said seat and said back, a desk pivotally and adjustably attached to one of said arms and selectively positionable between an operative position and an open position, said operative position being defined by said desk spanning said arms, support means for supporting said seat and said back on a supporting surface, said support means including a front leg assembly mounted adjacent a front portion of said seat and a rear leg assembly mounted adjacent a rear portion of said seat, said front leg assembly and said rear leg assembly extending downwardly from said seat into engagement with a supporting surface and being structurally adapted to support said seat and said back, said support means further including a retractable support base structure adapted to supplementally support said seat, said back, and said desk, and being pivotally connected to said front leg assembly so as to be positionable between a stored position and a supporting position, said supporting position being defined by said support base structure extending downwardly from said front leg assembly into engaging relation with the supporting surface so as to be substantially beneath said desk when said desk is in said operative position, and said seat, said back, said arms, said support means, and said desk all being pivotally interconnected so as to be collectively disposed between an open position and a fully collapsible position, whereby the chair assembly is substantially portable.

2. A folding chair assembly as recited in claim 1 further comprising an elongate lamp support extending upwardly on said back to a distal end zone above said back, and lamp means provided on said distal end zone of said lamp support and structured for illuminating the working surface.

3. A folding chair assembly as recited in claim 2 further including a power box secured to said back, said elongate lamp support extending from a top of said power box, said power box being further adapted to supply power to said lamp means.

4. A folding chair assembly as recited in claim 3 further including stop means on said top of said power box, said stop means being disposed to limit an amount which said elongate lamp support is allowed to rotate atop said power box.

5. A folding chair assembly as recited in claim 1 further including a pair of support rods, each of said support rods being pivotally secured at a proximal end thereof to said support base structure, said support rods being pivotally disposed between a retracted position and a supporting position wherein a free distal end of each of said support rods is supportably engaged with said front leg assembly so as to prevent said support base structure from moving to said stored position.

6. A folding chair assembly as recited in claim 5 wherein said open position of said desk is defined by a substantially perpendicular orientation of said desk relative to said one arm and out of spanning relation between said two arms.

7. A folding chair assembly recited in claim 6 further including clamp means disposed on said front leg assembly, said clamp means being structured and disposed to removably maintain said support base structure in said stored position.

8. A folding chair assembly recited in claim 6 wherein said desk includes an elongate hinge secured thereto and removably secured to said one arm, said hinge including a plurality of adjustment openings therein at which said hinge is adjustably secured to said one arm.

9. A folding chair assembly as recited in claim 8 further comprising latch means connected to said desk and structured to releasably maintain the desk in spanning relation between said two arms.

10. A folding chair assembly as recited in claim 9 wherein said desk comprises a receptacle structure defining an interior compartment thereof and a lid pivotally connected to a remainder of said desk and normally disposed in a closed position in overlying relation to said compartment, said lid when in said closed position, defining a working surface.

11. A folding chair assembly as recited in claim 10 further comprising lock means adapted to secure said lid of said desk in said closed position relative to said compartment.

12. A folding chair assembly as recited in claim 11 wherein tether means are provided in said compartment to hold articles in position when stored therein.

* * * * *